US008534055B2

(12) United States Patent
Lucht

(10) Patent No.: US 8,534,055 B2
(45) Date of Patent: Sep. 17, 2013

(54) FILTER ARRANGEMENT FOR EXHAUST AFTERTREATMENT SYSTEM

(75) Inventor: Erich A. Lucht, Arden Hills, MN (US)

(73) Assignee: Thermo King Corporation, Minneapolis, MN (US)

( * ) Notice: Subject to any disclaimer, the term of this patent is extended or adjusted under 35 U.S.C. 154(b) by 296 days.

(21) Appl. No.: 13/043,698

(22) Filed: Mar. 9, 2011

(65) Prior Publication Data

US 2011/0232264 A1 Sep. 29, 2011

(51) Int. Cl.
*F01N 3/00* (2006.01)

(52) U.S. Cl.
USPC ..... 60/295; 60/286; 60/288; 60/293; 60/303; 60/311

(58) Field of Classification Search
USPC ..... 60/274, 286, 287, 288, 289, 293, 60/295, 300, 303, 311
See application file for complete search history.

(56) References Cited

U.S. PATENT DOCUMENTS

| | | | | |
|---|---|---|---|---|
| 5,489,319 | A * | 2/1996 | Tokuda et al. | 96/400 |
| 5,822,977 | A * | 10/1998 | Fukuda et al. | 60/274 |
| 5,980,618 | A | 11/1999 | Holzmann et al. | |
| 6,032,538 | A | 3/2000 | Rickmann et al. | |
| 6,090,187 | A * | 7/2000 | Kumagai | 95/278 |
| 6,183,544 | B1 | 2/2001 | Ormond et al. | |
| 6,675,654 | B2 | 1/2004 | Hegner et al. | |
| 6,807,864 | B2 | 10/2004 | Takakuwa et al. | |
| 7,207,171 | B2 | 4/2007 | Nagaoka et al. | |
| 7,214,908 | B2 | 5/2007 | Wlodarczyk | |
| 7,254,940 | B2 | 8/2007 | Saitoh et al. | |
| 7,313,913 | B2 | 1/2008 | Okugawa et al. | |
| 7,322,186 | B2 | 1/2008 | Tochikawa et al. | |
| 7,421,839 | B2 * | 9/2008 | Igarashi | 60/297 |
| 7,472,610 | B2 | 1/2009 | Clerc et al. | |
| 7,487,634 | B2 | 2/2009 | Wakamatsu | |
| 7,550,119 | B2 * | 6/2009 | Kojima | 422/180 |
| 7,891,176 | B2 * | 2/2011 | Konstandopoulos | 60/297 |

FOREIGN PATENT DOCUMENTS

| | | | | |
|---|---|---|---|---|
| JP | 2002129941 A * | 5/2002 | | 60/295 |

* cited by examiner

*Primary Examiner* — Binh Q Tran
(74) *Attorney, Agent, or Firm* — Michael Best & Friedrich LLP

(57) ABSTRACT

An auxiliary filter arrangement for an exhaust aftertreatment system, such as a diesel particulate filter (DPF) system. The DPF communicates with an exhaust line to receive a flow of exhaust gases therethrough. An auxiliary filter is positioned in an auxiliary line or tube that connects an air supply, a pressure sensor, and/or any other aftertreatment system component to the exhaust line. The auxiliary filter can be a wire mesh filter operable to trap particulate or soot, thereby preventing the soot from traveling further up the auxiliary line toward the components of the air supply system, the pressure sensor, and/or the components of any other aftertreatment system communicating with the exhaust line through the auxiliary line.

20 Claims, 3 Drawing Sheets

FILTER ARRANGEMENT FOR EXHAUST AFTERTREATMENT SYSTEM

BACKGROUND

The present invention relates to exhaust aftertreatment systems for use with internal combustion diesel engines.

Exhaust aftertreatment systems, such as a diesel particulate filter (DPF) system, are commonly used to treat exhaust gases emitted from an internal combustion diesel engine. FIG. 1 schematically illustrates a conventional DPF system 10. The DPF 14 is positioned in-line with the exhaust line 18 for receiving the flow of exhaust gases. Particulate or soot traveling with the exhaust gases in the exhaust line 18 is trapped by the DPF 14 to clean the exhaust gases. As the particulate is collected by the DPF 14, a pressure sensor 22 in communication with the exhaust line 18 monitors the back pressure in the exhaust line 18. When a predetermined backpressure is reached, indicative of a sufficient quantity of particulate in the DPF 14, a controller 26 activates a heater 30 adjacent the DPF 14 and an air supply system (including a blower 34 and a control valve 38) to oxidize the particulate. The oxidation is commonly referred to as regeneration of the DPF 14.

SUMMARY

Operation of conventional DPF systems can be hindered by buildup of particulate or soot in the auxiliary lines or tubes that connect the air supply and the pressure sensor to the exhaust line. The present invention provides an auxiliary filter arrangement for an exhaust aftertreatment system, such as a DPF system. The DPF communicates with the exhaust line to receive the flow of exhaust gases therethrough. An auxiliary filter is positioned in an auxiliary line or tube that connects the air supply, the pressure sensor, and/or any other aftertreatment system component to the exhaust line. The auxiliary filter can be wire mesh, silicon-carbide wall-flow type media, or other effectively similar material operable to trap particulate or soot, thereby preventing the soot from traveling further up the auxiliary line toward the components of the air supply system, the pressure sensor, and/or the components of any other aftertreatment system communicating with the exhaust line through the auxiliary line.

In one embodiment, the air supply system and the pressure sensor are integrated into a single auxiliary line communicating with the exhaust line. The auxiliary filter is positioned proximate the intersection of the auxiliary line and the exhaust line to trap particulate or soot and prevent it from traveling up the auxiliary line toward the components of the air supply system and the pressure sensor. The auxiliary filter is also located proximate the heater of the DPF system so that activation of the heater and the air supply system to regenerate the DPF also results in the regeneration of the auxiliary filter. In other words, the particulate collected by the auxiliary filter is oxidized during the regeneration of the DPF, thereby simultaneously regenerating the auxiliary filter.

In another embodiment, the air supply system and the pressure sensor are positioned into separate auxiliary lines, each communicating with the exhaust line.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 2:
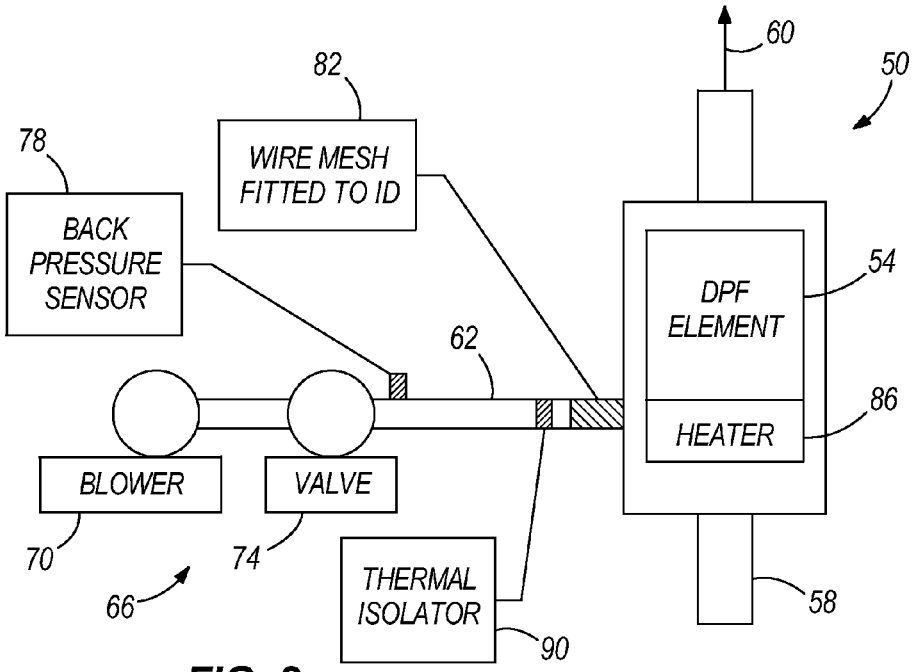
FIG. 2 schematically illustrates a diesel particulate filter system embodying the invention according to one embodiment.

FIG. 2 illustrates an exhaust aftertreatment system in the form of a diesel particulate filter (DPF) system 50 of the present invention, according to one embodiment. The DPF 54 is positioned in-line with the exhaust line 58 for receiving the flow of exhaust gases (represented by the arrow 60) from an internal combustion engine (not shown). In some embodiments, the engine is used to drive a vehicle, such as a truck or tractor, to drive a refrigeration system on a trailer or container refrigeration unit, to drive a generator on a shipping container, or to drive an auxiliary power unit of a tractor/trailer combination. Particulate or soot traveling with the exhaust gases in the exhaust line 58 is trapped by the DPF 54 to clean the exhaust gases 60. An auxiliary line 62 communicates with the exhaust line 58 and includes components associated with the regeneration of the DPF 54. Specifically, an air supply system 66 communicates with the exhaust line 58 via the auxiliary line 62. The air supply system 66 includes a blower 70 and a control valve 74 for regulating the airflow from the blower 70 through the auxiliary line 62. A back pressure sensor 78 also communicates with the exhaust line 58 via the auxiliary line 62.

Figure 4:
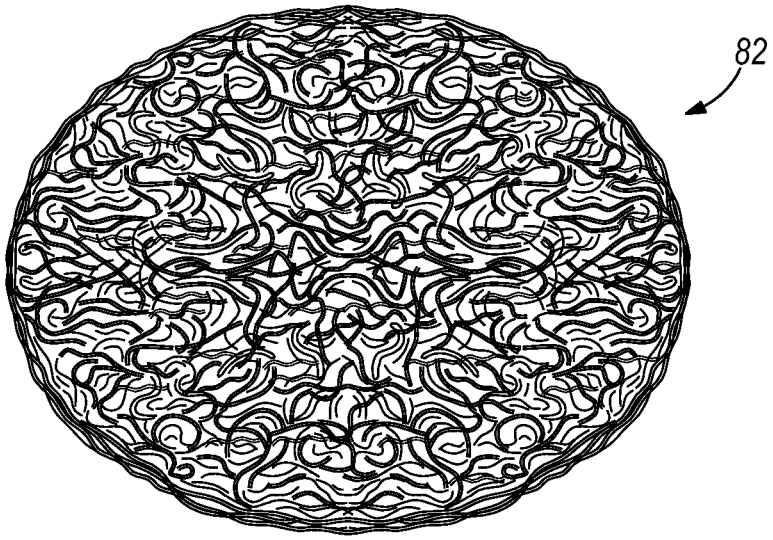
FIG. 4 is a perspective view of an auxiliary filter used in the system of FIGS. 2 and 3.

An auxiliary filter 82 is positioned proximate the intersection of the auxiliary line 62 and the exhaust line 58 to trap particulate or soot and prevent it from traveling up the auxiliary line 62 toward the blower 70, the valve 74, and the pressure sensor 78. In the illustrated embodiment, the auxiliary filter 82 is a wire mesh pad or plug (see FIG. 4) that can be fitted within the inner diameter of the tube, hose, or pipe defining the auxiliary line 62. Auxiliary filters of this construction are available in any desired shapes and sizes from Heraeus GmbH in Hanau, Germany. In other embodiments, the auxiliary filter 82 need not be positioned directly in the inner diameter of the auxiliary line 62, but instead can be positioned within the exhaust line 58 at the opening to the auxiliary line 62, or within a junction or fitting interconnecting the auxiliary line 62 and the exhaust line 58.

The auxiliary filter 82 is positioned to also be located proximate the heater 86 of the DPF system 50 so that activation of the heater 86 and the air supply system 66 to regenerate the DPF 54 also results in the regeneration of the auxiliary filter 82. In other words, the particulate collected by the auxiliary filter 82 is oxidized during the regeneration of the DPF 54, thereby simultaneously regenerating the auxiliary filter 82. The proximity of the auxiliary filter 82 to the heater 86 can vary in different systems depending upon the intensity of the regeneration at the DPF 54. This arrangement provides a more robust DPF system 50 because it improves the monitoring of the backpressure and the ability to supply air to the system for regeneration. Soot that might otherwise clog auxiliary lines communicating with the exhaust line 58, and hinder the regeneration operation, is trapped in the auxiliary filter 82 and periodically oxidized.

In the illustrated embodiment, a thermal isolator 90 is positioned in the auxiliary line 62 at a location between the auxiliary filter 82 and the sensor 78, the valve 74, and the blower 70. The thermal isolator 90 provides thermal protection to the sensor 78, the valve 74, and the blower 70 from the heat generated by the heater 86 and the regeneration of the filters 54 and 82. In particular, the thermal isolator 90 protects the pressure sensor 78 from the high temperatures that might damage the sensor 78 or affect its rated accuracy.

Figure 1:
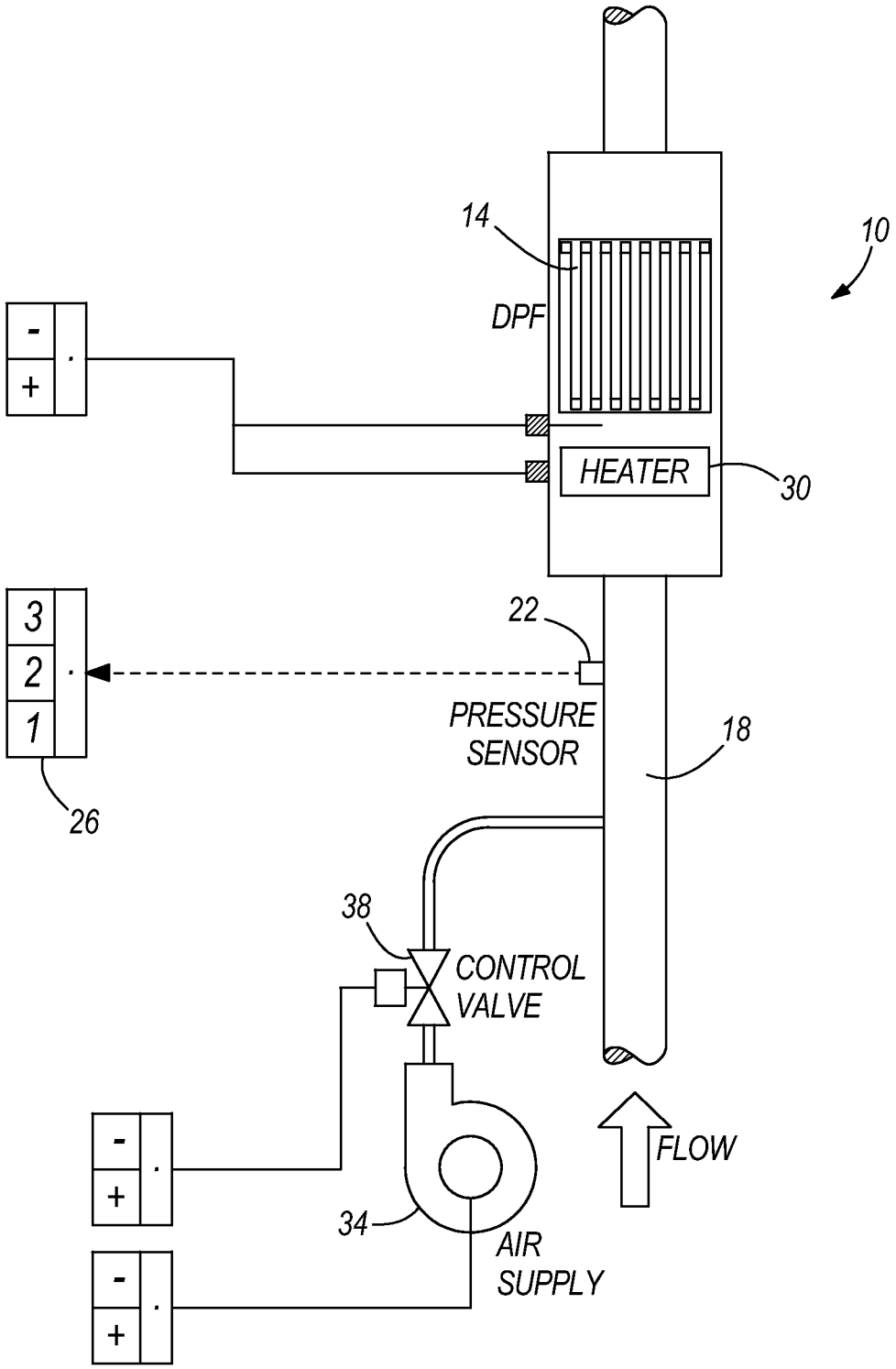
FIG. 1 PRIOR ART
FIG. 1 schematically illustrates a prior art diesel particulate filter system.
Figure 3:
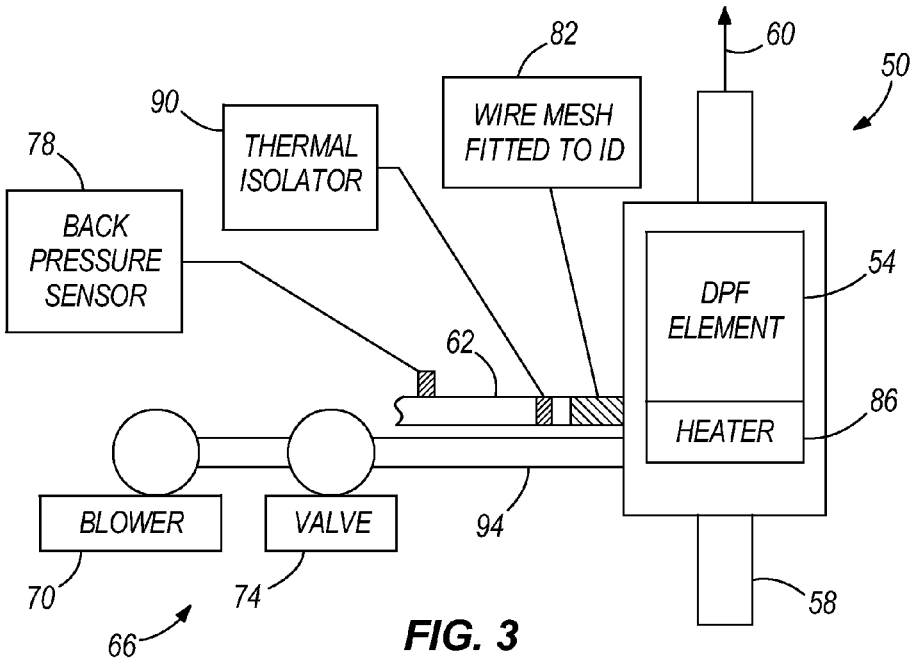
FIG. 3 schematically illustrates a diesel particulate filter system embodying the invention according to another embodiment.

While the embodiment illustrated in FIG. 2 integrates the air supply system 66 and the back pressure sensor 78 in a single auxiliary line 62, it should be understood that other embodiments, in which each of the air supply system 66 and the back pressure sensor 78 communicate with the exhaust line 58 via distinct auxiliary lines 62, 94 (similar to the arrangement shown in FIG. 1), are also contemplated by the invention, see FIG. 3. In such embodiments, there can be an auxiliary filter in each auxiliary line, and each auxiliary filter can be positioned proximate the heater for regeneration simultaneously with the regeneration of the DPF. The invention can also be used in auxiliary lines that communicate other aftertreatment system components with the exhaust line 58.

Various features and advantages of the invention are set forth in the following claims.

What is claimed is:

1. An exhaust aftertreatment system for use with an internal combustion diesel engine, the exhaust aftertreatment system comprising:

an exhaust line configured to receive exhaust from the internal combustion diesel engine;

a diesel particulate filter in line with the exhaust line and configured to collect a particulate from the exhaust;

a heater disposed adjacent to the diesel particulate filter for selective activation to regenerate the diesel particulate filter by oxidizing the particulate collected on the diesel particulate filter;

an auxiliary line in fluid communication with the exhaust line through an opening;

a pressure sensor in fluid communication with the exhaust line through the auxiliary line and configured to sense a pressure; and an auxiliary filter configured to collect additional particulate and positioned proximate the heater such that activation of the heater effects regeneration of the auxiliary filter.

2. The exhaust aftertreatment system of claim 1, further comprising a thermal isolator positioned in the auxiliary line between the opening and the pressure sensor, the thermal isolator configured to provide thermal protection for the pressure sensor.

3. The exhaust aftertreatment system of claim 1, further comprising an air supply system in fluid communication with the exhaust line through the auxiliary line, the air supply system including a blower, and a control valve, the blower configured to generate an airflow, and the control valve configured to regulate the airflow.

4. The exhaust aftertreatment system of claim 3, wherein the air supply system and the heater selectively regenerate the diesel particulate filter by oxidizing the particulate collected on the diesel particulate filter and the auxiliary filter based upon a predetermined change in pressure.

5. The exhaust aftertreatment system of claim 1, further comprising an air supply system in fluid communication with the exhaust line through a second auxiliary line in communication with the exhaust line through a second opening, the air supply system including a blower, and a control valve, the blower configured to generate an airflow, and the control valve configured to regulate the airflow.

6. The exhaust aftertreatment system of claim 5, wherein the air supply system and the heater selectively regenerate the diesel particulate filter by oxidizing the particulate collected on the diesel particulate filter and the auxiliary filter based upon a predetermined change in pressure.

7. The exhaust aftertreatment system of claim 1, wherein the auxiliary filter is a wire mesh.

8. The exhaust aftertreatment system of claim 1, wherein the auxiliary filter is positioned within the auxiliary line.

9. The exhaust aftertreatment system of claim 1, wherein the auxiliary filter is positioned within the exhaust line.

10. The exhaust aftertreatment system of claim 1, wherein the auxiliary line is a pipe.

11. A method of treating exhaust from an internal combustion engine, the method comprising:

generating exhaust with an internal combustion diesel engine;

directing the exhaust through an exhaust line;

filtering particulate from the exhaust with a diesel particulate filter in the exhaust line;

filtering additional particulate from the exhaust with an auxiliary filter adjacent an auxiliary line in fluid communication with the exhaust line through an opening;

sensing pressure with a pressure sensor in fluid communication with the exhaust line through the auxiliary line; and regenerating the auxiliary filter by heating the auxiliary filter with a heater disposed adjacent the diesel particulate filter to oxidize the additional particulate collected on the auxiliary filter.

12. The method of claim 11, further comprising regenerating the auxiliary filter and the diesel particulate filter simultaneously by heating the auxiliary filter and the diesel particulate filter with the heater disposed adjacent the diesel particulate filter to oxidize the additional particulate collected on the auxiliary filter and the particulate collected on the diesel particulate filter.

13. The method of claim 11, further comprising thermally isolating the pressure sensor from the diesel particulate filter with a thermal isolator in the auxiliary line between the opening and the pressure sensor.

14. The method of claim 11, further comprising generating an airflow through the diesel particulate filter from an air supply system located in the auxiliary line.

15. The method of claim 14, further comprising selectively regenerating the diesel particulate filter and the auxiliary filter by oxidizing the particulate collected on the diesel particulate filter and the auxiliary filter based upon a predetermined change in pressure.

16. The method of claim 11, further comprising generating an airflow through the diesel particulate filter from an air supply system located in a second auxiliary line including a second opening.

17. The method of claim 16, further comprising selectively regenerating the diesel particulate filter and the auxiliary filter by oxidizing the particulate collected on the diesel particulate filter and the auxiliary filter based upon a predetermined change in pressure.

18. The method of claim 11, further comprising positioning the auxiliary filter within the auxiliary line.

19. The method of claim 11, further comprising positioning the auxiliary filter within the exhaust line.

20. An exhaust aftertreatment system for use with an internal combustion diesel engine, the exhaust aftertreatment system comprising:

an exhaust line configured to receive exhaust from the internal combustion diesel engine;

a diesel particulate filter in line with the exhaust line and configured to collect a particulate from the exhaust;

a heater disposed adjacent to the diesel particulate filter for selective activation to regenerate the diesel particulate filter by oxidizing the particulate collected on the diesel particulate filter;

an auxiliary line in fluid communication with the exhaust line through an opening;

a pressure sensor in fluid communication with the exhaust line through the auxiliary line and configured to sense a pressure;

a thermal isolator positioned in the auxiliary line between the opening and the pressure sensor, the thermal isolator configured to provide thermal protection for the pressure sensor;

an auxiliary filter configured to collect additional particulate and positioned proximate the heater such that activation of the heater effects regeneration of the auxiliary filter; and an air supply system in fluid communication with the exhaust line through the auxiliary line.

* * * * *

UNITED STATES PATENT AND TRADEMARK OFFICE

CERTIFICATE OF CORRECTION

PATENT NO. : 8,534,055 B2
APPLICATION NO. : 13/043698
DATED : September 17, 2013
INVENTOR(S) : Lucht It is certified that error appears in the above-identified patent and that said Letters Patent is hereby corrected as shown below:

On the title page, Item (60) should read:

--Related U.S. Application Data

(60) Provisional application No. 61/318,639, filed on Mar. 29, 2010.--

Signed and Sealed this
Nineteenth Day of November, 2013

Teresa Stanek Rea

Teresa Stanek Rea
*Deputy Director of the United States Patent and Trademark Office*